United States Patent [19]

Brown

[11] Patent Number: 4,899,638

[45] Date of Patent: Feb. 13, 1990

[54] AUTOMATICALLY-REVERSING PISTON-AND-CYLINDER UNIT

[76] Inventor: Harold D. Brown, Box 394, Nickerson, Kans. 67561

[21] Appl. No.: 211,816

[22] Filed: Jun. 27, 1988

[51] Int. Cl.[4] ..... F01L 31/02

[52] U.S. Cl. ..... 91/346; 91/350

[58] Field of Search ..... 91/218, 344, 346, 350

[56] References Cited

U.S. PATENT DOCUMENTS

| | | | |
|---|---|---|---|
| 842,406 | 1/1907 | Lewis | 91/218 |
| 2,028,067 | 1/1936 | Heftye . | |
| 2,028,938 | 1/1936 | Logette et al. | 91/346 X |
| 2,379,483 | 7/1945 | Hopgood . | |
| 2,443,568 | 6/1948 | Palm | 91/346 X |
| 2,642,045 | 6/1953 | Potts . | |
| 2,742,880 | 4/1956 | Ball | 91/218 |
| 2,784,700 | 3/1957 | Griffith . | |
| 2,925,782 | 2/1960 | Sharpe et al. . | |
| 3,247,668 | 4/1966 | VanHecke et al. . | |
| 3,548,717 | 12/1970 | Passaggio | 91/350 X |
| 3,846,048 | 11/1974 | Robbins, Jr. | 417/393 |
| 4,674,958 | 6/1987 | Igarashi et al. | 417/225 |

FOREIGN PATENT DOCUMENTS

| | | | |
|---|---|---|---|
| 1024526 | 2/1958 | Fed. Rep. of Germany | 91/218 |

*Primary Examiner*—Edward K. Look

*Attorney, Agent, or Firm*—Litman, McMahon & Brown

[57] ABSTRACT

An automatically-reversing, fluid-actuated piston-and-cylinder unit includes a cylinder with a first section reciprocably receiving a piston and a second section reciprocably receiving a spool valve member. The piston is connected to a piston rod that extends slidably through the valve member. The valve member includes a plurality of lands that subdivide the cylinder second section into a plurality of fluid chambers. In a first position the valve member directs fluid to one side of the piston and in a second position it directs fluid to the other side of the piston. The valve member is automatically shifted between its first and second positions when the piston reaches its limits of travel.

7 Claims, 2 Drawing Sheets

Fig. 1.
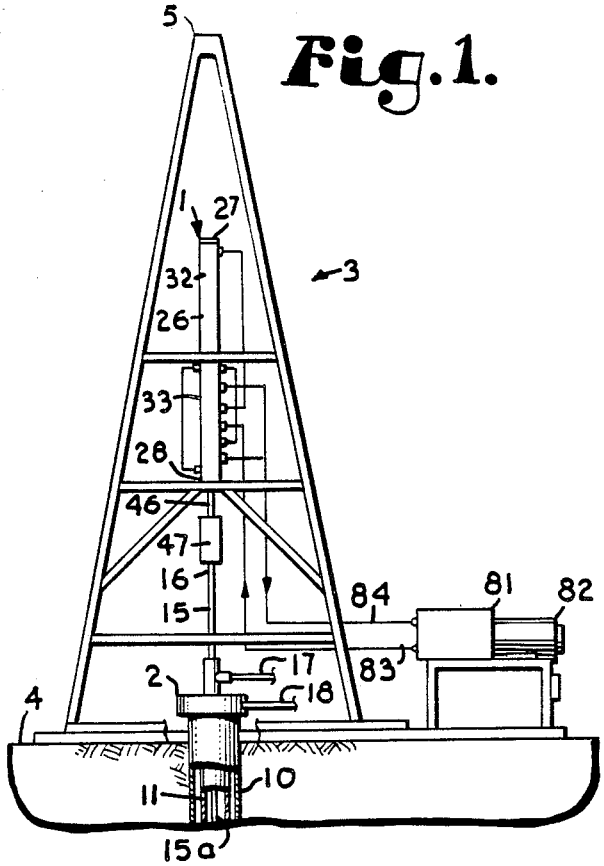
Fig. 2.
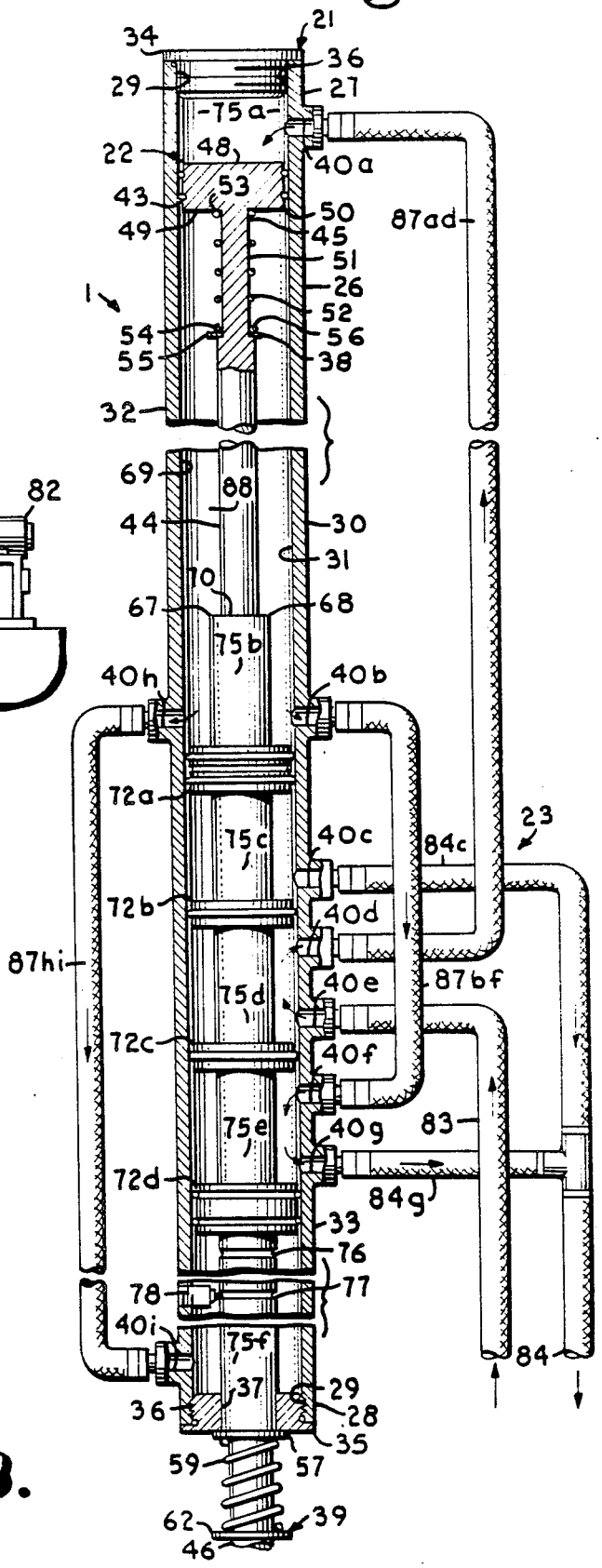
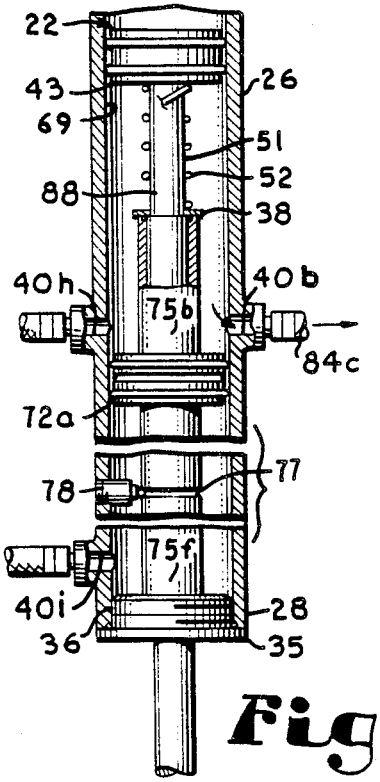
Fig. 3.

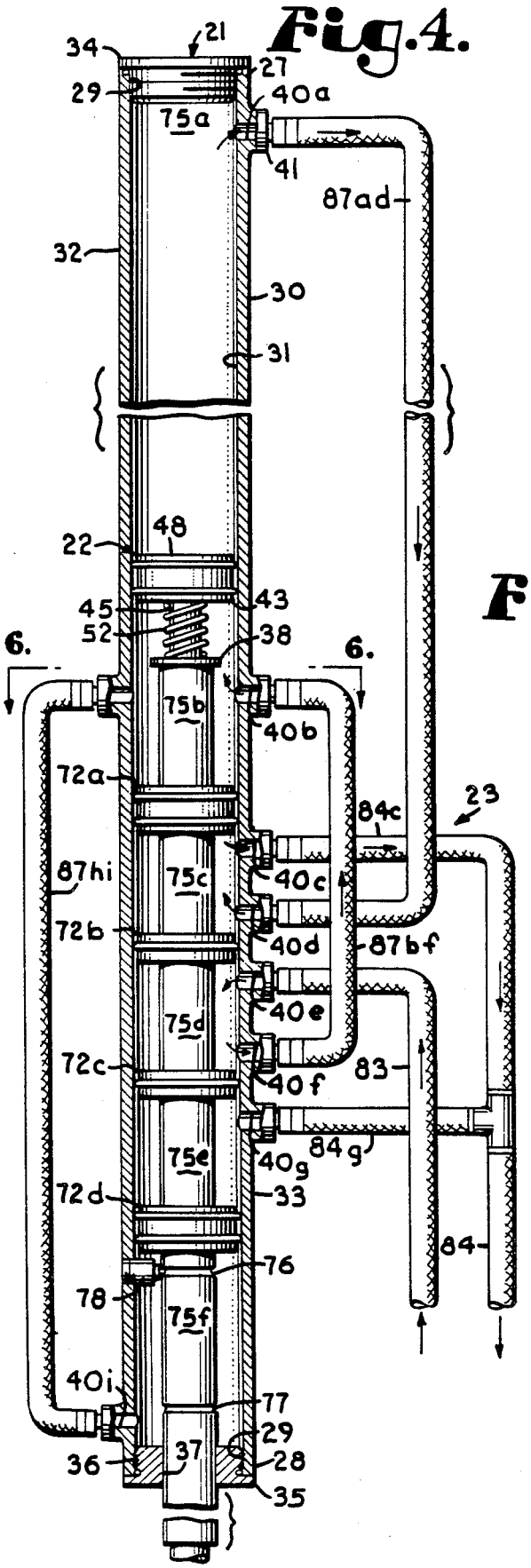
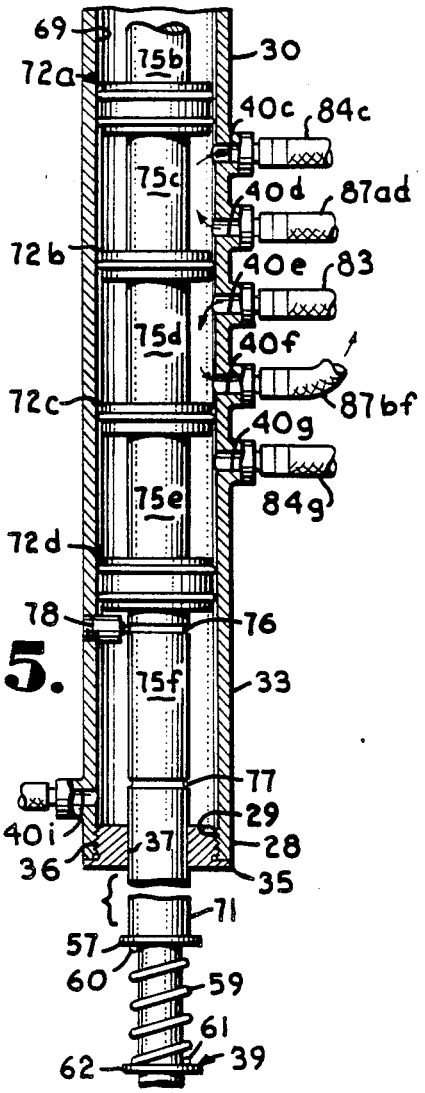
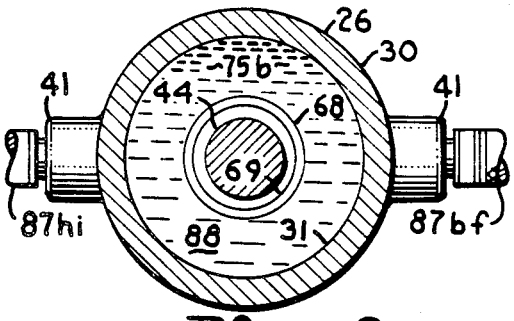
Fig.6.
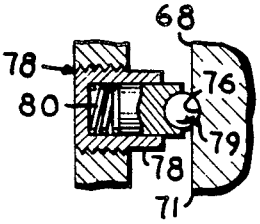
Fig.7.

AUTOMATICALLY-REVERSING PISTON-AND-CYLINDER UNIT

BACKGROUND OF THE INVENTION

1. Field of the Invention

The present invention relates generally to fluid-powered motors, and in particular to a valve for automatically reversing a hydraulic, piston-and-cylinder unit.

2. Description of the Prior Art

Fluid-powered devices are well known and a variety of different designs have been devised to meet the requirements of particular applications. These include hydraulic and pneumatic piston-and-cylinder units which are connected to pumps and compressors. Piston-and-cylinder units, or linear actuators, are found in various sizes in many types of equipment. Single-acting piston-and-cylinder units generally have a single fluid input located at a cylinder end and provide a linear force in one direction. Double-acting units generally include fluid inlets at both ends of their cylinders and provide linear force on both their extension and retraction strokes. Most hydraulic systems are "closed" whereby the actuating fluid is returned from the piston-and-cylinder units for recirculation. Pneumatic systems, on the other hand, can be "open" whereby the air, steam, etc. is released to the atmosphere after expending its energy and performing work.

Piston-and-cylinder units have heretofore been employed, for example, in petroleum recovery. Oil wells generally include submersible, reciprocating "down-hole" pumps in the production zone. These pumps are commonly actuated by pump jacks comprising pivotable walking beams connected to the pump at one end by a string of sucker rods and mounting counterweights at the other end to offset the load that must be lifted on each pumping stroke. This load, which comprises both the weight of the sucker rod string and the weight of the crude oil column in the well tubing, can be substantial in a relatively deep well. Accordingly, pump jacks often require massive counterweights. Electric motors or internal combustion engines are usually coupled to the walking beams by gear or belt-drive transmissions for providing the required rocking motion.

Although such pump jack systems have been extensively used for many years, they suffer from several disadvantages. The size, complexity and weight of a typical pump jack system, especially for a relatively deep well, add significantly to its cost. Moreover, power losses in the engines, motors and transmissions tend to reduce operating efficiencies. In fact, present electric power rates are such that the cost of operating an electric motor for a single pump jack may exceed $5,000.00 per month. Naturally, the initial and operating costs associated with pump jack systems are reflected in the cost of oil production. Furthermore, since pump jacks generally include large, moving parts that are clearly visible from a substantial distance, they tend to dramatically alter the visual aesthetics of the landscape wherever they are erected.

To overcome the aforementioned disadvantages of conventional pump jacks, hydraulic piston-and-cylinder units have heretofore been employed for actuating the down-hole pumps in oil wells. For example, a wellhead with a hydraulic pump actuator is disclosed in the Brown et al. U.S. Pat. No. 4,462,464 and includes a single-acting hydraulic piston-and-cylinder unit connected to a sucker rod string. A spool valve automatically reverses the piston-and-cylinder unit. Although the hydraulic pump actuator disclosed in this patent has certain advantages, its utility is somewhat limited because the single-acting cylinder is hydraulically driven only through its upstroke. The return or downstroke is accomplished by releasing the fluid in the cylinder lower end, whereby the piston is drawn downwardly by the weight of the sucker rod string. A double-acting actuator is often preferred for oil recovery, particularly if the down-hole pump is double-acting.

Electrically-actuated valves have also been tried on oil recovery piston-and-cylinder units. For example, one system employs upper and lower limit switches for shifting a solenoid-actuated valve at the upper and lower ends of the cylinder stroke. The valve diverts pressurized fluid from the pump to one end or the other of the hydraulic cylinder. When the cylinder reaches its uppermost or lowermost position, one of the limit switches is opened or closed whereby the solenoid-actuated valve shifts and pressurized fluid is diverted to the other cylinder end. Although this arrangement has some advantages over conventional pump jacks, a disadvantage is the dependence on the electromechanical switch and solenoid valve components. If one of these components fails, the solenoid valve may stick in one position and the system may be damaged by excessive fluid pressure accumulating in a cylinder end. Even if the system is not damaged, the failure of an important component may cause it to shut down. Downtime in oil producing rigs is generally very expensive, as are repairs since many rigs are in remote locations. Furthermore, since many rigs are unattended, a shutdown could go unnoticed until someone arrived to collect the accumulated oil and/or gas. It will be readily appreciated from the foregoing that reliability is extremely important in oil pumping systems.

SUMMARY OF THE INVENTION

In the practice of the present invention, a piston-and-cylinder unit is provided which communicates with a pressurized fluid source and includes first and second cylinder sections. A piston assembly includes a piston rod with a piston mounted on one end. The piston is reciprocably received in the first section of the cylinder.

A spool valve member includes a bore which slidably receives the piston rod. The spool valve member is positioned in the second section of the cylinder and is reciprocable between a first position directing pressurized fluid to one side of the piston and a second position directing pressurized fluid to the other side of the piston. The spool valve member includes opposite ends which are engaged by respective actuating subassemblies mounted on the piston rod as the piston reaches the limits of its travel. The spool valve member subdivides the second section of the cylinder into multiple chambers, one of which communicates with one side of the piston to maintain fluid pressure equilibrium therebetween.

OBJECTS OF THE INVENTION

The principal objects of the present invention are: to provide a hydraulically-actuated piston-and-cylinder unit; to provide such a piston-and-cylinder unit which is double-acting; to provide such a piston-and-cylinder unit which reverses automatically; to provide such a piston-and-cylinder unit which is highly reliable; to provide such a piston-and-cylinder unit which is capable of moving relatively large loads; to provide such a piston-and-cylinder unit which can be made with various stroke lengths; to provide such a piston-and-cylinder unit with a valve for automatically reversing the direction of piston travel and which is positively actuated at the limits of piston travel; and to provide such a piston-and-cylinder unit which is economical to manufacture, efficient in operation, capable of a long operating life and particularly well adapted for the proposed usage thereof.

BRIEF DESCRIPTION OF THE DRAWINGS

FIG. 1 is a side elevational view of an oil well with a piston-and-cylinder unit embodying the present invention.

FIG. 2 is a vertical, cross-sectional view of the piston-and-cylinder unit with the piston at its upper limit of travel.

FIG. 3 is a fragmentary, vertical, cross-sectional view of the piston-and-cylinder unit with the piston nearing the lower limit of its travel.

FIG. 4 is a vertical, cross-sectional view of the piston-and-cylinder unit with the piston at the lower limit of its travel.

FIG. 5 is a fragmentary, vertical cross-sectional view of the piston-and-cylinder unit with the piston nearing the upper limit of its travel.

FIG. 6 is a horizontal, cross-sectional view of the piston-and-cylinder unit taken generally along line 6—6 in FIG. 4.

FIG. 7 is an enlarged, fragmentary, vertical cross-sectional view of the piston-and-cylinder unit, particularly showing a positioning detent subassembly.

DETAILED DESCRIPTION OF THE PREFERRED EMBODIMENTS

I. Introduction and Environment

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally designates an automatically-reversing piston-and-cylinder unit. Without limitation on the generality of useful applications of the present invention, the piston-and-cylinder unit 1 is shown associated with a wellhead 2 of an oil well 3. The wellhead 2 is placed on a ground surface 4 and includes a derrick 5. The well 3 includes an outer casing 10 which receives well tubing 11. A down-hole, submersible pump (not shown) is reciprocably received in the lower end of the well tubing 11. The outer casing 10 and the well tubing 11 terminate at the wellhead 2. A sucker rod string 15 comprising individual, linked sucker rods 15*a* is connected to the down-hole pump and extends upwardly through the wellhead 2 to an upper end 16. On the upstroke of the sucker rod string 15, a column of crude oil in the well tubing 11 is lifted and discharged through an oil discharge line 17 to a storage reservoir (not shown). Natural gas flows upwardly through the outer casing 10 to the wellhead 2, whereat it is discharged for collection through a gas discharge line 18.

The piston-and-cylinder unit 1 generally comprises a cylinder assembly 21, a piston/valve assembly 22 and a hydraulic fluid system 23.

II. Cylinder Assembly

The cylinder assembly 21 includes a coaxial cylinder body 26 terminating at upper and lower ends 27, 28 with female, internal threading 29 and having a side wall 30 defining a coaxial bore 31. The cylinder assembly 21 generally comprises an upper section 32 reciprocably receiving a piston 50 and a lower section 33 reciprocably receiving a spool valve member 68.

Top and bottom plugs 34, 35 with male threading 36 corresponding to the female, internal threading 29 enclose the cylinder upper and lower ends 27, 28 respectively, the bottom plug 35 having a coaxial bore 37. A positioning detent subassembly 78 (FIG. 7) is mounted on the cylinder side wall 30 at the cylinder lower section 33 and includes a ball-tipped plunger 79 biased by a spring 80 into the cylinder bore 31.

The cylinder bore 31 is ported at fluid ports 40*a*–40*i* each associated with a respective fluid port boss 41 projecting outwardly from the side wall 30. Fluid port 40*a* is located in the cylinder upper section 33 adjacent the upper end 27 and fluid ports 40*b*–40*i* are located in the lower section 32.

III. Piston/Valve Assembly

The piston/valve assembly 22 includes a piston subassembly 43 with a piston rod 44 having upper and lower ends 45, 46, the lower end 46 being connected to the sucker rod string upper end 16 by suspension gear 47 and the upper end 45 mounting a piston 50 with an upper or first side 48 and a lower or second side 49. The piston rod 44 is reciprocably received in the plug bore 37. The piston rod upper end 45 mounts a coaxial piston 50 and includes a recessed neck 51 which extends through an upper valve actuating spring 52 with an upper end 53 engaging the piston 50 and a lower end 54 abutting an upper valve actuating washer 55. The upper valve actuating washer 55 is biased by the spring 52 against a shoulder 56 formed by the recessed neck 51. In proximity to its lower end 46, the piston rod 44 receives a lower valve actuating spring 59 with upper and lower ends 60, 61; the spring upper end 60 abutting a lower valve actuating washer 57 and the spring lower end 61 engaging a retaining ring 62 mounted on the piston rod 44. The upper valve actuating spring and washer 52, 55 comprise an upper or first valve actuating subassembly 38. The lower valve actuating washer and spring 57, 59 comprise a lower or second valve actuating subassembly 39.

A spool valve subassembly 67 is formed by the piston/valve assembly 22 and the cylinder lower section 33. The spool valve subassembly 67 includes the spool valve member 68, which includes a coaxial bore 69 reciprocably receiving the piston rod 44 and a plurality of spaced lands 72*a*–72*d*. The valve member 68 includes upper and lower ends 70, 71; the lower end 71 being reciprocably received in the bottom plug bore 37. As will be discussed more fully hereinafter, the valve member 68 is reciprocated within the cylinder bore 31 in the cylinder assembly lower section 32 by the piston subassembly 43. The piston 50 and the spool valve lands 72*a*–72*d* divide the cylinder bore 31 into the following fluid chambers 75*a*–75*f*: upper or first chamber 75*a*;

lower or second chamber 75*b;* upper or first return chamber 75*c;* supply chamber 75*d;* lower or second return chamber 75*e* and equilibrium chamber 75*f.* The piston 50 separates fluid chambers 75*a,b* adjacent upper or first piston side 48 and lower or second piston side 49 respectively; land 72*a* separates fluid chambers 75*b,c;* land 72*b* separates fluid chambers 75*c,d;* land 72*c* separates fluid chambers 75*d,e;* and land 72*d* separates fluid chambers 75*e,f.* The valve member 68 also includes upper and lower annular positioning grooves 76, 77 in the equilibrium fluid chamber 75*f* below the land 72*d* which selectively receive the detent plunger 79.

IV. Hydraulic Fluid System

The hydraulic fluid system 23 includes a pressurized fluid source comprising a pump 81 driven by a motor 82 and connected to a fluid supply line 83 connected to fluid port 40*e.* A return fluid line 84 returns fluid to the pump 81 and includes upper and lower branches 84*c,* 84*g* connected to fluid outlet ports 40*c,* 40*g* respectively. Fluid port interconnection lines 87*ad,* 87*bf* and 87*hi* interconnect fluid ports 40*a,d;* 40*b,f;* and 40*h,i* respectively.

V. Operation

The piston-and-cylinder unit 1 positively reciprocates the sucker rod string 15 on both its up and down strokes and the piston/valve assembly 22 automatically reverses the piston-and-cylinder unit 1 at the top and bottom of its strokes.

FIG. 2 shows the piston 50 at its uppermost position just as a downstroke of the piston-and-cylinder unit 1 is about to commence. The spool valve subassembly 67 is also in its upper position, and is retained there by the positioning detent subassembly 78 registering with the lower positioning groove 77. Pressurized hydraulic fluid 88 enters the fluid supply chamber 75*d* through supply line 83 and fluid port 40*e.* From the chamber 75*d* the fluid 88 flows through the interconnect line 87*ad* to the upper piston chamber 75*a,* which forces the piston 50 down. The fluid 88 in the lower piston chamber 75*b* below the piston 50 is forced through interconnect line 87*bf* into the lower return chamber 75*e,* and thence through the return line branch 84*g* to the return line 84 for return to the pump 81.

FIG. 3 shows the piston 50 nearing the lowermost position of its downstroke, with the upper valve actuating washer 55 engaging the spool valve member upper end 70. The upper valve actuating spring 52 will then compress slightly to cushion the impact on the spool valve member upper end 70 until the force in the upper actuating spring 52 is sufficient to overcome the retaining force of the positioning detent subassembly 78. The spool valve member 68 is thus shifted downwardly.

FIG. 4 shows the piston 50 in its lowermost position about to commence its upward stroke and the spool valve member 68 in its lowermost position retained by the positioning detent subassembly 78 in the upper positioning groove 76. FIG. 4 also shows the upper valve actuating spring 52 slightly compressed as compared to FIGS. 2 and 3, since it compresses when shifting the spool valve member 68 downwardly. The restraining force exerted by the positioning detent subassembly 78 is adjustable by varying the tension in the detent spring 80 so that positive shifting of the spool valve member 68 can occur between its upper and lower positions at the appropriate intervals. With the spool valve member 68 in its lowermost position, pressurized fluid 88 from supply chamber 75*d* communicates via the interconnect line 87*bf* with the lower piston chamber 75*b* to force the piston 50 upwardly. Fluid 88 in the upper piston chamber 75*a* above the piston 50 flows through the interconnect line 87*ad* to the upper return chamber 75*c* and thence is returned to the pump 81 via the return line 84 and its upper branch 84*c.*

FIG. 5 shows the piston 50 nearing its upper limit of travel, i.e., during the last part of its upstroke, and shows the spool valve member 68 in its lowermost position and about to be shifted upwardly. The lower valve actuating washer 57 has just impinged upon the spool valve member lower end 71 whereby the lower valve actuating spring 59 will be compressed and shift the spool valve member 68 upwardly.

The equilibrium chamber 75*f* is expanded when the spool valve member 68 is in its upper position (FIGS. 2 and 3) and is contracted when the spool valve member 68 is in its lower position (FIGS. 4 and 5). The equilibrium chamber 75*f* communicates with the lower piston chamber 75*b* via the interconnect line 87*hi* whereby the fluid pressure in the lower piston chamber 75*b* and the equilibrium chamber 75*f* is substantially equalized. Thus, the spool valve member 68 is placed in substantial equilibrium between the fluid chambers 75*b* and 75*f* and will generally be unaffected by changing fluid pressures throughout the cylinder assembly 21. The spool valve member 68 will therefore be dependably and positively actuated at the appropriate times during the cycle, i.e., when impinged by the upper and lower valve actuating washers 55, 57. It will be appreciated that since the spool valve subassembly 67 directs the pressurized fluid to the appropriate chambers, relatively precise positioning and shift timing are important to the proper operation of the piston-and-cylinder unit 1.

In addition to the exemplary application of the present invention described above, it could be useful for a variety of other applications where a fluid-actuated, linear, reciprocating motor is required. For example, bilge pumps on ships could be operated by piston-and-cylinder units according to the present invention, with the actuating fluid comprising steam. Other exemplary uses include as a drilling mud pump on a well-drilling rig and as a recoil compensator for an artillery piece.

It is to be understood that while certain forms of the present invention have been illustrated and described herein, it is not to be limited to the specific forms or arrangement of parts described and shown.

What is claimed and desired to be secured by Letters Patent is as follows:

1. A fluid-actuated piston-and-cylinder unit, which comprises:

(a) a cylinder including:
  (1) first and second ends;
  (2) a bore extending longitudinally between said first and second ends; and
  (3) first and second sections associated with said first and second ends respectively;

(b) a piston/valve assembly including:
  (1) a piston subassembly having a piston rod with first and second ends and a piston mounted on said first end, said piston being reciprocably received in said cylinder first section and having first and second sides; and
  (2) a spool valve subassembly having a spool valve member with a longitudinally extending bore slidably receiving said piston rod, said spool valve member having a first position communicating fluid from said cylinder second section to said cylinder first section whereby said piston is reciprocated in said cylinder first section in a power stroke and a second position whereat said piston is permitted to retract in said cylinder first section in a return stroke;

(c) means for engaging said spool valve member with said piston subassembly whereby said spool valve member is moved between its first and second positions.

(d) said cylinder, said piston subassembly and said spool valve subassembly being generally coaxial;

(e) said cylinder first and second sections being generally annular and coaxial with said cylinder, said piston subassembly and said spool valve subassembly; and (f) a fluid interconnect line positioned exteriorally of said cylinder and fluidically communicating said cylinder first and second sections with said spool valve member in its first position.

2. The piston-and-cylinder unit according to claim 1 wherein:

(a) said cylinder first section is divided into first and second piston fluid chambers by said piston; and (b) said spool valve member is adapted to direct fluid to said first piston fluid chamber in its first position and to said second piston fluid chamber in its second position.

3. The valve assembly according to claim 2 wherein (a) said spool valve member defines a return chamber in said cylinder second section adapted to selectively receive return fluid from one of said piston fluid chambers.

4. The piston-and-cylinder unit according to claim 2, which includes:

(a) said spool valve equilibrium fluid chamber in said cylinder second section; and (b) interconnect line means connecting said second piston fluid chamber and said equilibrium fluid chamber whereby fluid pressure in each is substantially equal.

5. The piston-and-cylinder unit according to claim 2, which includes:

(a) a fluid inlet port in said cylinder;

(b) first and second fluid outlet ports in said cylinder;

(c) said spool valve member forming a first return fluid chamber in said cylinder second section, said first return fluid chamber communicating with said second piston fluid chamber and with said first fluid outlet port with said valve member in its first position;

(d) said spool valve member forming a second return fluid chamber in said cylinder second section, said second return fluid chamber communicating with said first piston fluid chamber and with said second fluid outlet port with said valve member in its second position;

(e) said spool valve member forming a supply fluid chamber in said cylinder second section, said supply fluid chamber communicating with said first piston fluid chamber with said valve member in its first position and communicating with said second piston fluid chamber with said valve member in its second position; and (f) said valve member forming an equilibrium fluid chamber in said cylinder second section, said equilibrium fluid chamber communicating with said second piston fluid chamber.

6. An automatically-reversing, fluid-actuated piston-and-cylinder unit, which comprises:

(a) a cylinder comprises:

(1) first and second ends;

(2) a bore extending longitudinally between said first and second ends;

(3) first and second sections associated with said first and second ends respectively;

(4) a first cylinder plug closing said first cylinder end; and (5) a second cylinder plug having a bore and closing said second cylinder end;

(b) a piston/valve assembly including:

(1) a piston subassembly having a piston rod with first and second ends and a piston mounted on said first end, said piston being reciprocably received in said cylinder first section and having first and second sides;

(2) a spool valve subassembly having a spool valve member with first and second ends and a longitudinally extending bore slidably receiving said piston rod, said spool valve member second end extending through said second cylinder plug bore, said spool valve member having a first position communicating pressurized fluid from said cylinder second section to said piston first side and a second position communicating pressurized fluid from said cylinder second section to said piston second side;

(c) said piston dividing said cylinder first section into a first piston fluid chamber associated with said first piston side and a second piston fluid chamber associated with said second piston side;

(d) said spool valve member having a plurality of lands dividing said cylinder second section into first and second return fluid chambers, a supply fluid chamber and an equilibrium fluid chamber;

(e) said spool valve member in its first position communicating fluid from said supply fluid chamber to said first piston fluid chamber and from said second piston fluid chamber to said second return fluid chamber;

(f) said spool valve member in its second position communicating fluid from said supply fluid chamber to said second piston fluid chamber and from said first piston fluid chamber to said first return fluid chamber;

(g) first and second valve actuating subassemblies associated with said piston rod first and second ends respectively, each said valve actuating subassembly including a respective valve actuating spring and being adapted to selectively engage a respective spool valve member end for shifting said spool valve member between its first and second positions;

(h) said cylinder, piston subassembly and spool valve subassembly being generally coaxial;

(i) said fluid chambers being generally annular and generally coaxial with said cylinder, said piston subassembly and said spool valve subassembly;

(j) a first fluid interconnect line fluidically interconnecting said cylinder second section and said piston first side with said spool valve member in its first position;

(k) a second fluid interconnect line fluidically interconnecting said cylinder second section and said piston second side with said spool valve member in its second position;

(l) a third fluid interconnect line fluidically interconnecting said second piston fluid chamber and said equilibrium chamber;

(m) a fluid inlet port fluidically communicating with said supply fluid chamber;

(n) a first fluid outlet port fluidically communicating with said first return fluid chamber;

(o) a second outlet port fluidically communicating with said return fluid chamber;

(p) said fluid interconnect lines being located exteriorally of said cylinder; and (q) said inlet and outlet ports being adapted for connection to a fluid pump whereby a fluidically closed system is provided.

7. The piston-and-cylinder unit according to claim 6, which includes:

(a) detent means adapted to selectively retain said valve member in its first and second positions.

* * * * *